United States Patent [19]

Hunt

[11] 4,064,962

[45] Dec. 27, 1977

[54] MUFFLER METHOD AND APPARATUS

[75] Inventor: Raymon E. Hunt, Longview, Tex.

[73] Assignee: Garlock Inc.

[21] Appl. No.: 622,039

[22] Filed: Oct. 14, 1975

Related U.S. Application Data

[63] Continuation of Ser. No. 436,149, Jan. 24, 1974, abandoned.

[51] Int. Cl.[2] ..... F01N 1/08

[52] U.S. Cl. ..... 181/272

[58] Field of Search ..... 181/48, 49, 54, 56, 181/57, 59, 61, 70

[56] References Cited

U.S. PATENT DOCUMENTS

| | | | |
|---|---|---|---|
| 1,114,701 | 10/1914 | Maxim | 181/59 |
| 2,717,048 | 9/1955 | Deremer | 181/61 |
| 2,950,777 | 8/1960 | Deremer | 181/54 |
| 3,388,769 | 6/1968 | Martoia | 181/56 |
| 3,434,565 | 3/1969 | Fischer | 181/48 |
| 3,470,979 | 10/1969 | Everett | 181/56 |
| 3,519,098 | 7/1970 | Plaga, Jr. | 181/57 |
| 3,583,524 | 6/1972 | Dubois | 181/54 |
| 3,741,336 | 6/1973 | Malosh | 181/33 D |

*Primary Examiner*—Robert K. Schaefer
*Assistant Examiner*—Vit W. Miska
*Attorney, Agent, or Firm*—Schovee & Boston

[57] ABSTRACT

A muffler having a low frequency silencing element therein that can be contained within the spatial limitations of a conventional muffler without increasing the back pressure. The low frequency silencing element includes a plurality of axially extending transfer tubes thus allowing the low frequency silencing element to function effectively while the exhaust gas flow is directed through the transfer tubes. Different numbers and different diameters of transfer tubes can be used. The outlet section of the transfer tubes can be used to create a high frequency resonator, if desired. Dispersive silencing elements can also be used without a significant increase in back pressure.

27 Claims, 16 Drawing Figures

MUFFLER METHOD AND APPARATUS

CROSS REFERENCE TO RELATED APPLICATIONS

This application is a continuation application of patent application Ser. No. 436,149, filed Jan. 24, 1974 entitled MUFFLER METHOD AND APPARATUS by Raymon E. Hunt, now abandoned.

BACKGROUND OF THE INVENTION

1. Field of the Invention

This invention relates to mufflers for reducing the exhaust noise of exhaust gases of internal combustion engines, and in particular for a muffler for a high output, high speed diesel engine.

2. Description of the Prior Art

When pure exhaust noise for a high output, high speed diesel engine must be below 78 to 80 dB (A), measured fifty feet from the source, the firing frequency and low order harmonics must be considered. The high sound pressure levels at these frequencies, which range from 100 to 300 Hz for high output, high speed diesel engines are a problem. Conventional mufflers, due to the relatively small volume allowed by space restrictions, do not reduce the low frequency noise effectively or if they do, the back pressure imposed on the engine is too great.

SUMMARY OF THE INVENTION

The muffler includes a low frequency silencing element, without increasing the volume of the muffler or increasing back pressure, by using a plurality of axially extending transfer tubes, through each of which a portion of the downstream exhaust gas flow is directed, in the low frequency silencing element. The muffler can also include a plurality of resonator chambers, cavities and dispersive elements in a wide variety of different configurations. The transfer tubes in the low frequency silencing element can be of different diameters, and different numbers of transfer tubes can be used. Each of the transfer tubes and the tuning tube have an opening in a chamber inlet upstream from the low frequency resonator chamber.

BRIEF DESCRIPTION OF THE DRAWINGS

The present invention will be more fully understood by reference to the following detailed description thereof, when read in conjunction with the attached drawings, wherein like reference numerals refer to like elements and wherein.

It is to be noted that the drawings are diagrammatic and not necessarily to scale, further, the baffle plates are preferably made of sheet metal of about the same thickness as that of the shell, and having a flange at both the O.D. and the I.D. as shown, for example, in U.S. Pat. No. 3,515,242.

DETAILED DESCRIPTION OF THE PREFERRED EMBODIMENTS

Figure 1:
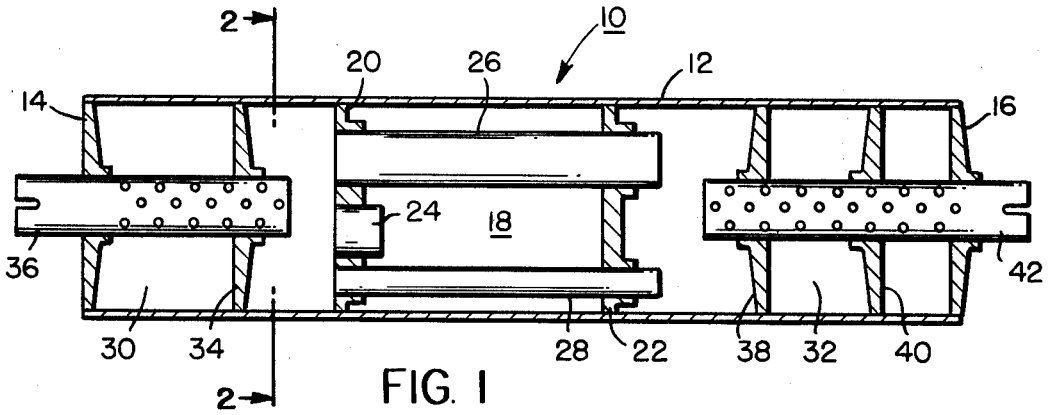
FIG. 1 is a longitudinal cross-sectional view through one embodiment of a muffler according to the present invention.
Figure 2:
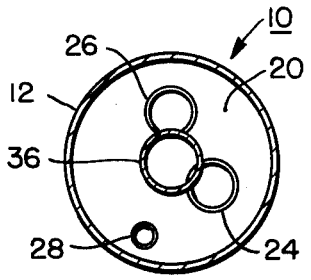
FIG. 2 is a transverse cross-sectional view along lines 2—2 of the muffler of FIG. 1.

With reference now to the drawings, FIG. 1 shows a muffler 10 having a cylindrical shell 12 closed at the entrance by an inlet header 14 and closed at the exit by an exit header 16. According to the present invention, the muffler 10 includes a low frequency silencing element or resonator 18 formed between a pair of baffle plates 20 and 22, having an off-center inlet, tuning tube 24 and two axially extending transfer tubes 26 and 28, spaced around the periphery of the shell 12 and extending axially or longitudinally of the muffler 10 between the two baffle plates 20 and 22. It is noted that, in this embodiment, the transfer tubes 26 and 28 have different diameters.

This design provides a low frequency silencing element (i.e. the low frequency resonator 18) in the muffler 10 without increasing the volume of the muffler and without increasing the back pressure; in fact, in some cases this design, wherein the exhaust gas flow is directed through the transfer tubes, actually reduces the back pressure.

In addition to the low frequency resonator 18, the muffler 10 has various conventional design features including a mid range resonator 30 and a mid range resonator 32. The mid range resonator 30 is located between the inlet header 14 and a baffle plate 34 and has a perforated inlet tube 36 extending therebetween. The mid range resonator 32 includes a pair of baffle plates 38 and 40 and a perforated outlet tube 42 extending through the plates 38 and 40 and through the exit header 16.

In one embodiment, the shell 12 has a diameter of 10 inches, the transfer tubes 26 and 28 have diameters of 4 inches and 2 inches, respectively, the tuning tube has a diameter of 4 inches, and the low frequency resonator 18 has a length of 14 inches.

In operation, gas flowing from left to right through the muffler 10 is subjected to various sound attenuation actions and in particular to low frequency (for example 200 Hz) sound attenuation by the resonator 18 while the exhaust gas flow is directed through the transfer tubes 26 and 28.

Figure 3:
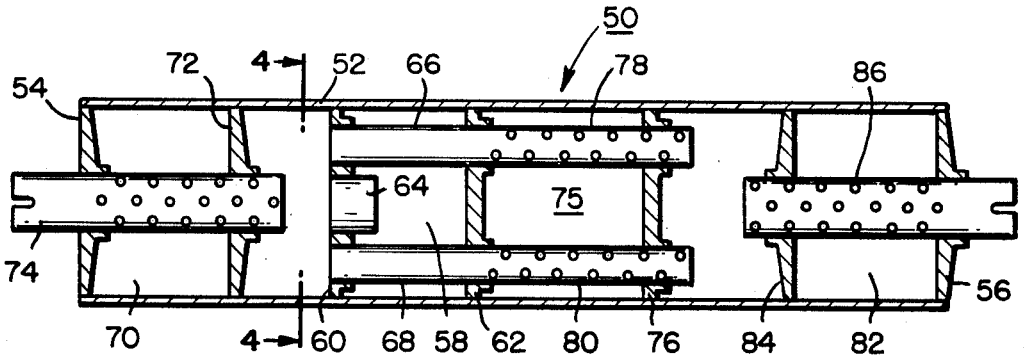
FIG. 3 is a longitudinal cross-sectional view through another embodiment of a muffler according to the present invention.

FIG. 3 shows a muffler 50 having a cylindrical shell 52 closed at the entrance by an inlet header 54 and closed at the exit by an exit header 56. According to this embodiment of the invention a low frequency resonator 58 is formed between a pair of baffle plates 60 and 62, has a concentric tuning tube 64 leading into the low frequency resonator 58, and two transfer tubes 66 and 68 of identical diameters diametrically opposed around the periphery of the shell 52 and extending longitudinally of the muffler 50 between the two baffle plates 60 and 62.

Figure 4:
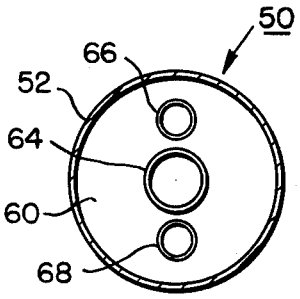
FIG. 4 is a transverse cross-sectional view along lines 4—4 of the muffler of FIG. 3.

In addition, the muffler 50 includes a mid-range resonator 70, a high frequency resonator 75, and a midrange resonator 82. The mid-range resonator 70 includes a baffle plate 72 and a perforated inlet tube 74 extending between the inlet header 54 and the baffle plate 72. The high frequency resonator 75 is formed between the baffle plate 62 and another baffle plate 76, between which baffle plates perforated extension tubes 78 and 80 of the transfer tubes 66 and 68 extend. The mid-range resonator 82 includes a baffle plate 84 and a perforated outlet tube 86 extending between the baffle plate 84 and the exit header 56. The design shown in FIGS. 3 and 4 allows the extension tubes 78 and 80 of the transfer tubes 66 and 68 to be used to create the relatively high frequency resonator 75, if desired, which relatively high frequency resonator 75 has not normally been used in a conventional muffler.

Figure 5:
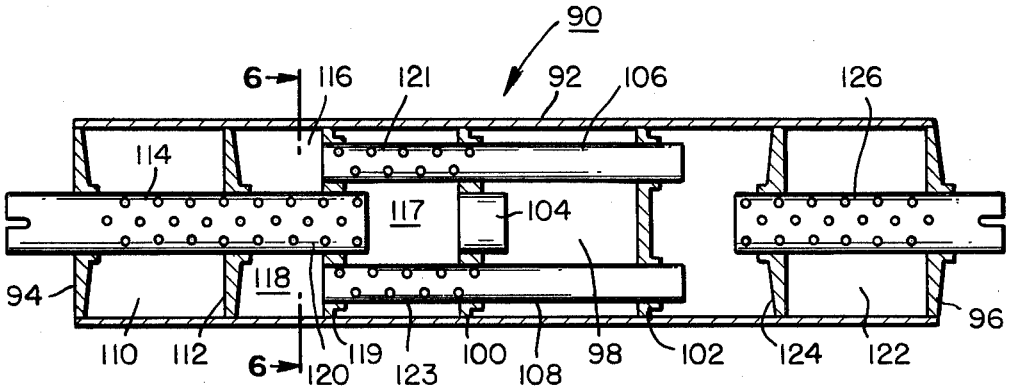
FIG. 5 is a longitudinal cross-sectional view through another embodiment of a muffler according to the present invention.
Figure 6:
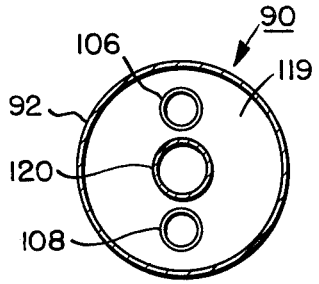
FIG. 6 is a transverse cross-sectional view along lines 6—6 of the muffler of FIG. 5.

FIGS. 5 and 6 show a muffler 90 having a cylindrical shell 92 closed at the entrance by an inlet header 94 and at the exit by an exit header 96. The muffler 90 includes a low frequency resonator 98 between a pair of baffle plates 100 and 102, having a concentric tuning tube 104 and two identical transfer tubes 106 and 108 spaced diametrically opposed around the periphery of the shell 92 and extending longitudinally of the muffler 90 between the two baffle plates 100 and 102.

In addition, the muffler 90 includes a mid-range resonator 110 between a baffle plate 112 and the inlet header 94 and including a perforated inlet tube 114, a dispersive element 116 comprising a chamber 118 between the baffle plate 112 and a baffle plate 119 and including a perforated extension 120 of the perforated inlet tube 114 extending between the baffle plates 112 and 119. The muffler 90 also includes a mid-range resonator 122 between a baffle plate 124 and the exit header 96 and includes a perforated exit tube 126.

The muffler 90 also includes another dispersive element 117 between baffle plates 119 and 100 and includes perforated extension tubes 121 and 123 of transfer tubes 106 and 108 extending between the baffle plates 119 and 100, and includes the perforated tube 120 as an inlet tube extending partway into the dispersive element 117.

Figure 7:
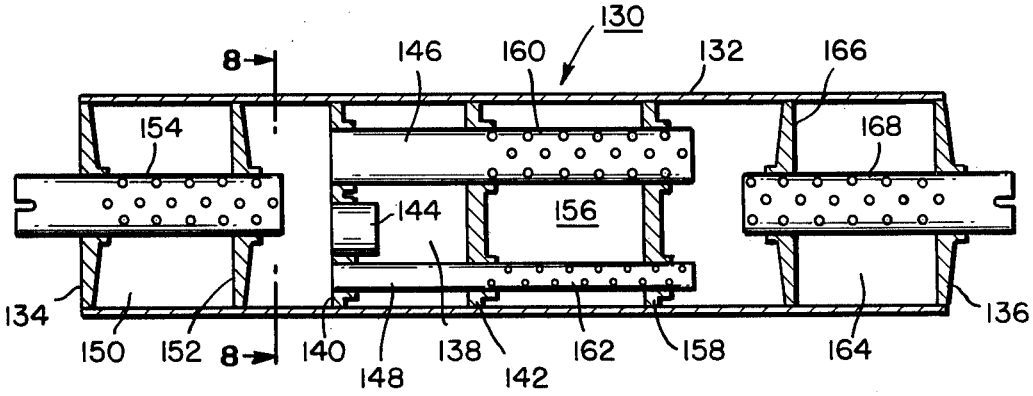
FIG. 7 is a longitudinal cross-sectional view through another embodiment of a muffler according to the present invention.
Figure 8:
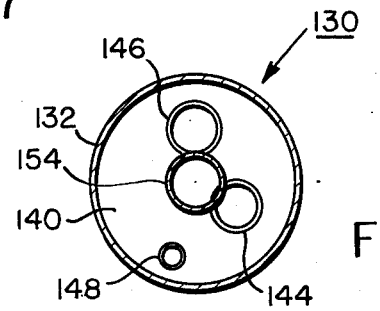
FIG. 8 is a transverse cross-sectional view along lines 8—8 of the muffler of FIG. 7.

FIGS. 7 and 8 show a muffler 130 having a cylindrical shell 132 and closed at the entrance by an inlet header 134 and closed at the exit by an exit header 136. In this embodiment the muffler 130 includes a low frequency resonator 138 formed between a pair of baffle plates 140 and 142, having an off-center tuning tube 144 and two transfer tubes 146 and 148 space around the periphery of the shell 132 and extending longitudinally of the muffler 130 between the two baffle plates 140 and 142.

In addition, this embodiment includes a midrange resonator 150 between a baffle plate 152 and the inlet header 134 and including a perforated inlet tube 154. The muffler 130 also includes a high frequency resonator 156 between the baffle plate 142 and another baffle plate 158 and including perforated extension tubes 160 and 162 of the transfer tubes 146 and 148. The muffler 130 also includes a mid-range resonator 164 between a baffle plate 166 and the exit header 136 and includes a perforated outlet tube 168.

Figure 9:
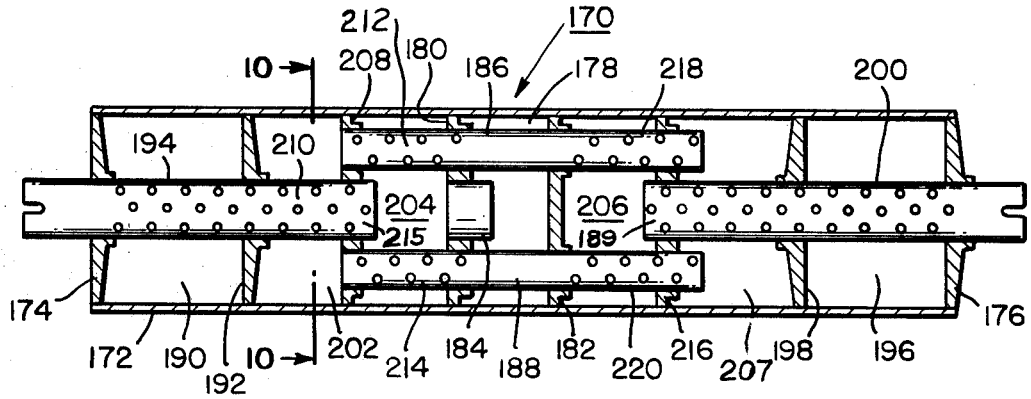
FIG. 9 is a longitudinal cross-sectional view through another embodiment of a muffler according to the present invention.
Figure 10:
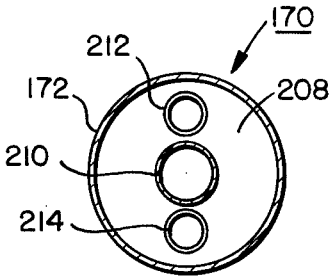
FIG. 10 is a transverse cross-sectional view along lines 10—10 of the muffler of FIG. 9.

FIGS. 9 and 10 show a muffler 170 having a cylindrical shell 172 closed at the entrance by an inlet header 174 and closed at the exit by an exit header 176. The muffler 170 includes a low frequency resonator 178 formed between a pair of baffle plates 180 and 182, having a concentric tuning tube 184 and a pair of identical, diametrically opposed transfer tubes 186 and 188 spaced around the periphery of the shell 172 and extending longitudinally of the muffler 170 between the baffle plates 180 and 182.

In addition, the muffler 170 has a mid-range resonator 190 located between the entrance header 174 and a baffle plate 192, and a perforated inlet tube 194 extending between the inlet header 174 and the baffle plate 192. The muffler 170 also includes a mid-range resonator 196 located between a baffle plate 198 and the exit header 176 and having a perforated exit tube 200 extending therebetween. The muffler 170 also includes dispersive elements 202, 204, 206 and 207. Dispersive element 202 is located between baffle plate 192 and a baffle plate 208 and includes a perforated extension tube 210 of the inlet tube 194. The dispersive element 204 is located between a baffle plate 208 and baffle plate 180 and includes perforated extension tubes 212 and 214 of the transfer tubes 186 and 188 and includes a short inlet tube 215 which is the terminal end of the extension tube 210. The dispersive element 206 is located between the baffle plate 182 and a baffle plate 216 and includes perforated extension tubes 218 and 220 of transfer tubes 186 and 188 and an exit tube 189 being the entrance end of the exit tube 200.

Figure 11:
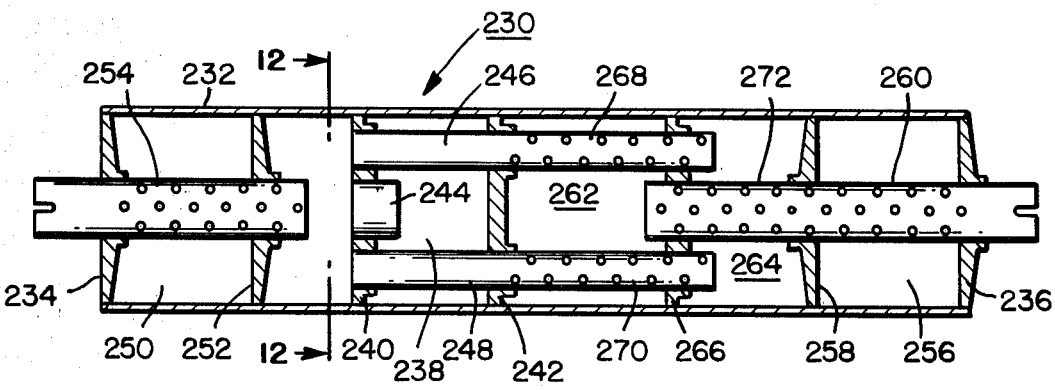
FIG. 11 is a longitudinal cross-sectional view through another embodiment of a muffler according to the present invention.
Figure 12:
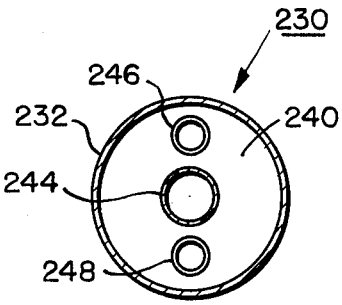
FIG. 12 is a transverse cross-sectional view along lines 12—12 of the muffler of FIG. 11.

FIGS. 11 and 12 show a muffler 230 having a cylindrical shell 232 enclosed at the entrance by the inlet header 234 and enclosed at the exit by an exit header 236. The muffler 230 has a low frequency resonator 238 between a pair of baffle plates 240 and 242, has a concentric tuning tube 244 and a pair of identical diametrically opposed transfer tubes 246 and 248 spaced around the periphery of the shell 232 and extending longitudinally of the muffler 230 between the two baffle plates 240 and 242.

In addition, the muffler 230 has a mid-range resonator 250 between the inlet header 234 and a baffle plate 252 and includes a perforated inlet tube 254 extending therebetween. The muffler 230 has another mid-range resonator 256 between the exit header 236 and a baffle plate 258 and includes a perforated exit tube 260 extending therebetween concentric with the shell 232. The muffler 230 also includes dispersive elements 262 and 264. The dispersive element 262 is located between the baffle plate 242 and a baffle plate 266 and includes two perforated extension tubes 268 and 270 of the transfer tubes 246 and 248. The dispersive element 264 is located between the baffle plates 266 and 258 and includes a perforated, concentric extension tube 272 of the exit tube 260.

Figure 13:
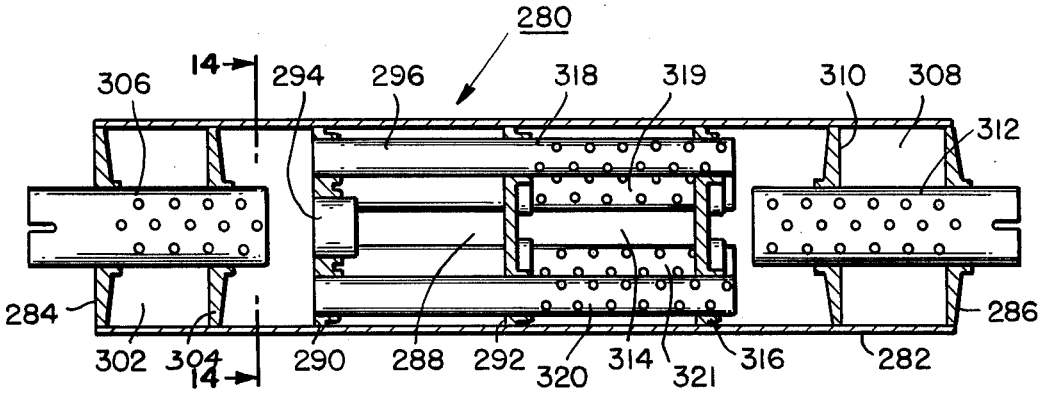
FIG. 13 is a longitudinal cross-sectional view through another embodiment of a muffler according to the present invention.
Figure 14:
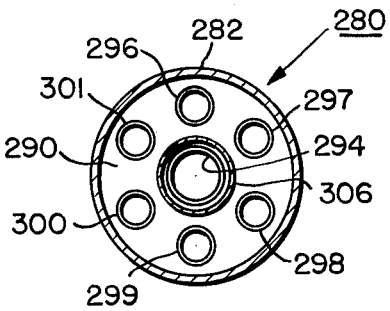
FIG. 14 is a transverse cross-sectional view along lines 14—14 of the muffler of FIG. 13.

FIGS. 13 and 14 show a muffler 280 having a cylindrical shell 282 closed at the entrance by an inlet header 284 and closed at the exit by an exit header 286. In this embodiment, the muffler 280 includes a low frequency resonator 288 between a pair of baffle plates 290 and 292, including a concentric tuning tube 294 and a plurality of identical, equally spaced-apart transfer tubes 296, 297, 298, 299, 300 and 301, spaced around the periphery of the shell 282 and extending longitudinally of the muffler 280 between the two baffle plates 290 and 292.

In addition, the muffler 280 has a mid-range resonator 302 between an inlet header 284 and a baffle plate 304 and including a perforated inlet tube 306. The muffler also includes a mid-range resonator 308 between a baffle plate 310 and the exit header 286 and including a concentric perforated exit tube 312.

The muffler 280 also has a high frequency resonator 314 located between the baffle plate 292 and a baffle plate 316 and includes perforated extension tubes 318, 319, 320, 321, 322, and 323 (only 4 of which are shown in FIG. 13) which are extensions of the transfer tubes 296–301.

Figure 15:
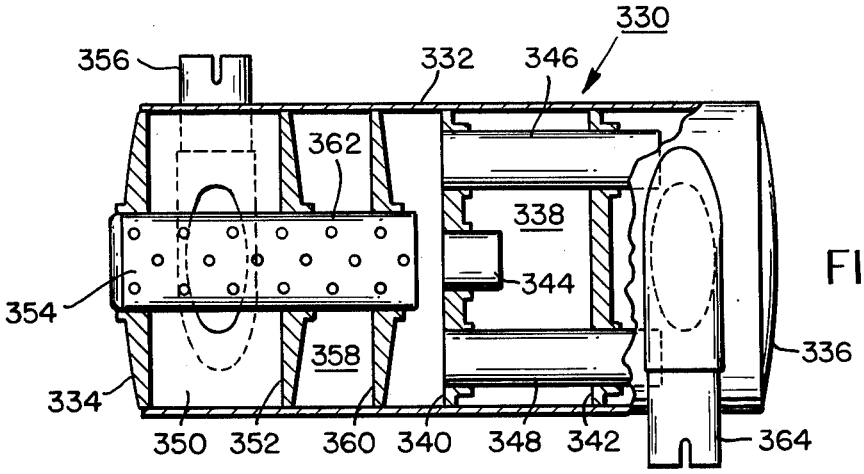
FIG. 15 is a longitudinal cross-sectional view through another embodiment of a muffler according to the present invention.
Figure 16:
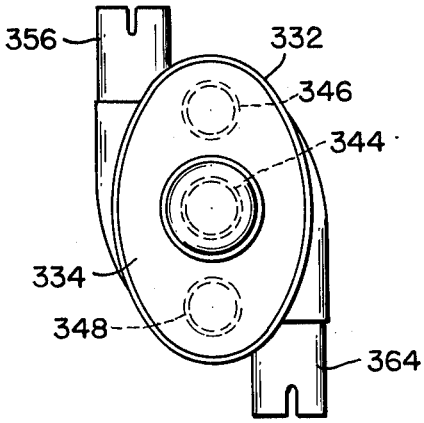
FIG. 16 is an end view of the muffler of FIG. 15.

FIGS. 15 and 16 show a muffler 330 having an oval shell 332 closed at the two ends by a pair of end walls 334 and 336. The muffler 330 includes a low frequency resonator 338 located between a pair of baffle plates 340 and 342, having a cylindrical tuning tube 344 in line with the axis of the shell 332 and having a pair of identical transfer tubes 346 and 348 spaced, diametrically opposed, around the periphery of the shell 332 and extending longitudinally of the muffler 330 between the two baffle plates 340 and 342.

The muffler 330 also includes a dispersive element 350 located between the end wall 334 and a baffle plate 352 and has a perforated tube 354 extending axially of the muffler between the end wall 334 and the baffle plate 352, and an inlet tube 356 extending transversely to the axis of the shell 332 and tangentially into the space between the end wall 334 and the baffle plate 352. The muffler 330 also includes a mid-range resonator 358 between the baffle plate 352 and a baffle plate 360 and includes a perforated extension tube 362 of the perforated tube 354. The exhaust gases leave the muffler 330 through an outlet tube 364 extending tangentially from the shell 332, transverse to the axis of the shell 332 and on the opposite side of the shell from the inlet tube 356.

As can be seen from the above description, the muffler of the present invention includes a tubular shell (preferably either a cylindrical shell or a shell elliptical in cross-section-other shapes can be used) enclosing a muffler chamber and having an inlet end and an outlet end closed by an inlet end wall and an outlet end wall, respectively, including an inlet tube extending through the shell into the muffler chamber adjacent the inlet end thereof, and an outlet tube extending through the shell and out of the muffler chamber adjacent the outlet end thereof, and including the low frequency silencing element or resonator of the present invention. The low frequency silencing element includes a pair of spaced-apart baffle plates, a tuning tube through the baffle plate closest to the inlet end of the muffler, and a plurality of transfer tubes extending between the baffle plates for carrying the exhaust gases through the low frequency silencing element. The spacing of the baffle plates and the location and size of the tuning tube are predetermined to provide the desired attenuation at various or selected frequencies as will be understood by one skilled in the art. Various other sound attenuation devices can be employed in the muffler as described above and as will be understood by one skilled in the art. It is noted that the baffle plates, such as plates 20 and 22 of FIG. 1, are imperforate except for the tuning tube and transfer tubes, and the term "imperforate baffle plate is hereby defined, for use in the present specification and claims to mean imperforate except for such tubes. It is also noted that the tuning tube and the transfer tubes, or at least that portion thereof in the low frequency resonator chamber are imperforate. Further, the term "transfer tube" is hereby defined to mean a tube that conducts at least a portion of the net flow of exhaust gas through the muffler to atmosphere.

Various combinations of the elements shown above can be made, for example, the high frequency resonator 314 of FIG. 13 can be used in a muffler similar to the 330 of FIG. 15.

The invention has been described in detail with particular reference to the preferred embodiment thereof, but it will be understood that variations and modifications can be effected within the spirit and scope of the invention as described hereinabove and as defined in the appended claims.

I claim:

1. The method of reducing the low frequency exhaust noise of a high output high speed diesel engine without increasing the volume of a muffler and without substantially increasing the back pressure imposed by said muffler on the engine, comprising positioning a pair of imperforate spaced-apart baffle plates in said muffler to define a low frequency resonator chamber therebetween, providing a tuning tube through that one of said baffle plates closest to an inlet end of said muffler, said tuning tube being imperforate in said chamber and having an inlet opening thereinto in a first chamber immediately upstream from said low frequency resonator chamber and having an outlet opening therefrom in said low frequency resonator chamber, carrying a portion of the entire downstream net exhaust gas flow through said low frequency resonator chamber through each of a plurality of longitudinal transfer tubes, that are imperforate in said chamber, extend between said pair of baffle plates, have an inlet opening thereinto in a chamber upstream from said low frequency resonator chamber and have an outlet opening therefrom in a chamber downstream from said low frequency resonator chamber, and carrying exhaust gas directly downstream from said downstream chamber.

2. The method according to claim 1 including positioning said transfer tubes around the periphery of said low frequency resonator chamber.

3. An exhaust muffler for internal combustion engines comprising:

a. an elongated tubular shell including an inlet end wall and an outlet end wall enclosing a muffler chamber, b. an inlet tube extending through said shell and into said chamber, c. an outlet tube extending through said shell and into said chamber; and d. a low frequency resonator chamber in said muffler chamber comprising imperforate first and second baffle plates being spaced-apart and defining therebetween a low frequency resonator chamber, a tuning tube extending through said first baffle plate and extending into said low frequency resonator chamber, and a plurality of transfer tubes extending between the first and second baffle plates, each transfer tube carrying net exhaust gas flow through said low frequency resonator chamber, said tuning tube and transfer tubes being imperforate in said low frequency resonator chamber, said tuning tube having an inlet opening thereinto in a first chamber immediately upstream from said low frequency resonator chamber and having an outlet opening therefrom in said low frequency resonator chamber, said transfer tubes each having an inlet opening thereinto in a chamber upstream from said low frequency resonator chamber and each having an outlet opening therefrom in a chamber downstream from said low frequency resonator chamber and means for carrying exhaust gas away from said downstream chamber in a direction directly downstream therefrom, whereby the full net downstream gas flow through said low frequency resonator chamber is split up with a portion thereof going through each of said transfer tubes.

4. The muffler according to claim 3 wherein said first baffle plate is closer to said inlet end wall than is said second baffle plate.

5. The muffler according to claim 3 wherein said muffler also includes in said muffler chamber at least one midrange resonator.

6. The muffler according to claim 3 wherein said muffler also includes at least one high frequency resonator in said muffler chamber.

7. The muffler according to claim 3 wherein said muffler also includes at least one dispersive element in said muffler chamber.

8. The muffler according to claim 3 wherein the axis of said tuning tube is in line with the axis of said shell.

9. The muffler according to claim 3 wherein the axis of said tuning tube is parallel to but off-center from the axis of said shell.

10. The muffler according to claim 3 wherein said shell is cylindrical and said inlet and outlet tubes are cylindrical and concentric with respect to said shell and extend axially into said muffler chamber through said inlet end wall and out of said muffler chamber through said outlet end wall, respectively.

11. The muffler according to claim 1 wherein said plurality of transfer tubes are all located around the periphery of said low frequency resonator chamber.

12. The muffler according to claim 1 wherein all of the tubes passing through said first baffle plate consist of only said tuning tube and transfer tubes.

13. The muffler according to claim 1 wherein said shell has an elliptical cross-section, and said inlet and outlet tubes are transverse to the longitudinal axis of said shell and extend through said shell tangentially to said shell, adjacent said inlet and outlet end walls, respectively.

14. The muffler according to claim 13 including at least one mid-range resonator in said muffler chamber.

15. The muffler according to claim 22 including a third baffle plate positioned adjacent said inlet end wall and including a perforated tube extending between said inlet end wall and through said third baffle plate.

16. The muffler according to claim 10 wherein said inlet tube is perforated and extends between said inlet end wall and a third baffle plate spaced a predetermined distance from said inlet end wall to provide a mid-range resonator chamber between said inlet end wall and said third baffle plate.

17. The muffler according to claim 16 wherein said outlet tube is perforated and extends between said outlet end wall and a fourth baffle spaced a predetermined distance away from said outlet end wall and providing between said outlet end wall and said fourth baffle a mid-range resonator chamber.

18. The muffler according to claim 17 wherein said plurality of transfer tubes all have identical diameters.

19. The muffler according to claim 17 wherein said plurality of transfer tubes comprise tubes of different diameters.

20. The muffler according to claim 17 wherein said transfer tubes extend beyond said second baffle plate toward said outlet end wall and through a fifth baffle plate providing a high frequency resonator chamber between said second baffle plate and said fifth baffle plate and wherein said portions of said transfer tubes extending between said second baffle and said fifth baffle are perforated.

21. The muffler according to claim 17 including a fifth baffle plate positioned between said third baffle and said first baffle plate and wherein said perforated inlet tube also extends between said third and said first baffle plate providing a dispersive element between said first and third baffle plates, and wherein said transfer tubes include perforated portions thereof extending between said first and fifth baffle plates.

22. The muffler according to claim 17 wherein said plurality of transfer tubes comprises a pair of identical diameter transfer tubes spaced diametrically opposed from the axis of said shell in which the tuning tube has a diameter larger than that of said transfer tubes and has an axis concentric with the axis of said shell.

23. The muffler according to claim 17 wherein said plurality of transfer tubes comprises two transfer tubes of different diameters and wherein said tuning tube has a diameter equal to that of the larger diameter transfer tube and has an axis spaced off-center from the axis of said shell.

24. The muffler according to claim 17 including a fifth baffle plate positioned between the first and third baffles plates and a sixth baffle plate positioned between said second and fourth baffle plates and wherein said transfer tubes include perforated extensions thereof extending between said first and fifth baffle plates and between said second and sixth baffle plates, said first and fifth baffle plates and said fourth and sixth baffle plates providing dispersive elements therebetween.

25. The muffler according to claim 17 including a fifth baffle plate positioned between said second and fourth baffle plates and including perforated extensions of said transfer tubes extending between said second and fifth baffle plates, said perforated outlet tube also extending between said fifth baffle plate and said fourth baffle plate, said second and fifth baffle plates providing a dispersive element therebetween and said fifth and fourth baffle plates providing an additional dispersive element therebetween.

26. The muffler according to claim 17 including a fifth baffle positioned between said second baffle and said fourth baffle and wherein said transfer tubes include perforated extensions extending between said second baffle and said fifth baffle plate, said second and fifth baffle plates providing therebetween a high frequency resonator chamber.

27. The muffler according to claim 26 wherein said transfer tubes comprise six equal diameter transfer tubes equally spaced around the periphery of said muffler chamber and wherein said tuning tube has a diameter larger than that of said transfer tubes and is concentric with said shell.

* * * * *

UNITED STATES PATENT AND TRADEMARK OFFICE

CERTIFICATE OF CORRECTION

PATENT NO. : 4,064,962

DATED : December 27, 1977

INVENTOR(S) : Raymon E. Hunt

It is certified that error appears in the above-identified patent and that said Letters Patent are hereby corrected as shown below:

Claim 11, line 1, delete "1" and substitute therefor --3--.

Claim 12, line 1, delete "1" and substitute therefor --3--.

Claim 13, line 1, delete "1" and substitute therefor --3--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*